US009416621B2

(12) United States Patent
Mackenzie et al.

(10) Patent No.: US 9,416,621 B2
(45) Date of Patent: Aug. 16, 2016

(54) COILED TUBING SURFACE OPERATED DOWNHOLE SAFETY/BACK PRESSURE/CHECK VALVE

(71) Applicant: Baker Hughes Incorporated, Houston, TX (US)

(72) Inventors: Gordon Mackenzie, Cypress, TX (US); Graeme Michael Kelbie, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 299 days.

(21) Appl. No.: 14/176,080

(22) Filed: Feb. 8, 2014

(65) Prior Publication Data

US 2015/0226030 A1 Aug. 13, 2015

(51) Int. Cl.

| | |
|---|---|
| ***E21B 34/06*** | (2006.01) |
| ***E21B 34/14*** | (2006.01) |
| *E21B 34/00* | (2006.01) |

(52) U.S. Cl.

CPC ..... *E21B 34/066* (2013.01); *E21B 34/14* (2013.01); *E21B 2034/005* (2013.01)

(58) Field of Classification Search

USPC ..... 166/373, 66

See application file for complete search history.

(56) References Cited

U.S. PATENT DOCUMENTS

| | | | | |
|---|---|---|---|---|
| 4,696,343 | A * | 9/1987 | Anderson | E21B 33/136 166/164 |
| 6,041,857 | A * | 3/2000 | Carmody | E21B 34/066 166/324 |
| 6,543,532 | B2 * | 4/2003 | Estep | E21B 34/066 166/66.4 |
| 7,287,591 | B2 * | 10/2007 | Campbell | E21B 27/02 166/162 |
| 2006/0162939 | A1 | 7/2006 | Vick, Jr. et al. | |
| 2010/0096124 | A1 * | 4/2010 | Naumann | E21B 17/206 166/250.01 |
| 2010/0264346 | A1 | 10/2010 | Bussear | |
| 2012/0067595 | A1 * | 3/2012 | Noske | E21B 23/02 166/373 |

* cited by examiner

*Primary Examiner* — Taras P Bemko

(74) *Attorney, Agent, or Firm* — Shawn Hunter

(57) ABSTRACT

Systems and methods for allowing intervention into a wellbore with a valve assembly that can be selectively opened and closed. An intervention work string has a multi-cycle open/close valve assembly which can be selectively opened to perform intervention tasks in the wellbore.

13 Claims, 4 Drawing Sheets

COILED TUBING SURFACE OPERATED DOWNHOLE SAFETY/BACK PRESSURE/CHECK VALVE

BACKGROUND OF THE INVENTION

1. Field of the Invention

The invention relates generally to devices and methods for operation of downhole valves. In particular aspects, the invention relates to the control of valves used in wellbore intervention technology.

2. Description of the Related Art

Following a primary production period for a wellbore, wellbore intervention is often needed to pump fluids, chemicals, etc. or transport tools into and out of the wellbore. Deviated or horizontal wellbores or wellbore portions can preclude the use of wireline intervention. Where tubulars, and particularly coiled tubing, are used to facilitate such interventions, the string will typically require one or more internal safety valves such as flapper-type or check-type valves. These safety valves prevent the flow of wellbore hydrocarbons into the coiled tubing but also may limit some preferable intervention operations.

SUMMARY OF THE INVENTION

The present invention provides systems and methods for allowing intervention into a wellbore with a valve assembly that can be selectively opened and closed. In described embodiments, the present invention relates to an intervention work string having a multi-cycle open/close valve assembly. The valve assembly is preferably used in a coiled tubing intervention bottom hole assembly wherein the coiled tubing has electrical or fiber optic communication within it. The valve assembly could be run in in either a normally-opened or normally-closed position and functioned by means of communication from the surface via electric or fiber optic conduit.

In a described embodiment, the valve assembly includes a plurality of flapper valves that are spring biased toward a closed position. The valve assembly also includes a valve actuation mechanism that can move each of the flapper valves between closed and open positions. An exemplary valve actuation assembly includes a roller screw member that is rotatable within the valve housing. Rotation of the roller screw member will move a prong member axially within the valve housing to urge the flapper valves open. Rotation of the roller screw member in the opposite direction will move the prong member axially within the valve housing in the opposite direction, thereby allowing the flapper valves to close.

When the valve assembly is in an open position, various intervention related tasks can then be performed. For example, tools could be passed down through the intervention work string and emplaced in the wellbore. In addition, fluids or chemicals could be flowed into the wellbore or out of the wellbore internally via the coiled tubing conduit.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
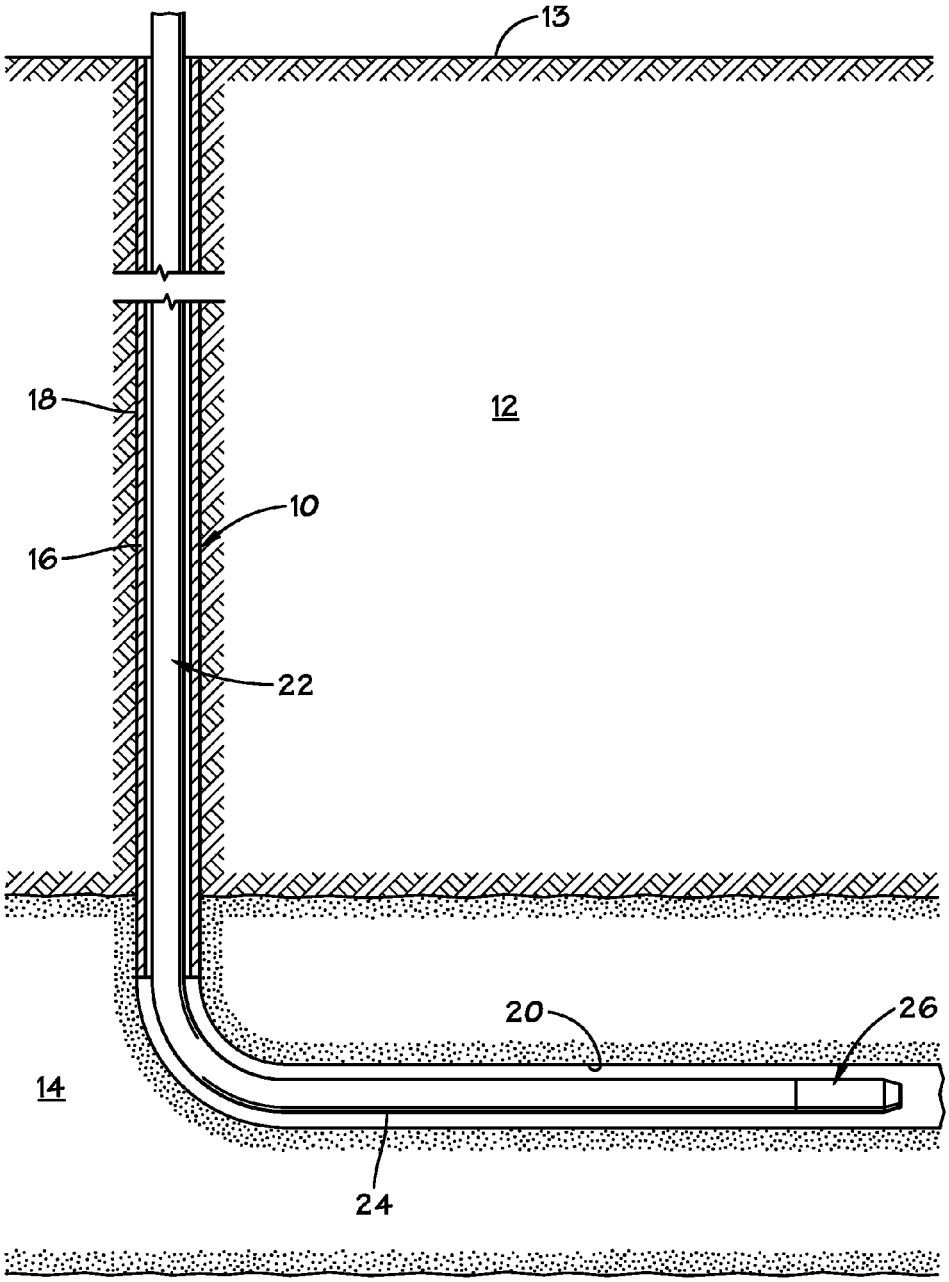
FIG. 1 is a side, cross-sectional view of an exemplary wellbore containing an intervention work string constructed in accordance with the present invention.

FIG. 1 illustrates an exemplary wellbore 10 that has been drilled through the earth 12 from the surface 13 down to a hydrocarbon-bearing formation 14. The wellbore 10 is partially lined with a metallic casing 16 of a type known in the art. The wellbore 10 has a substantially vertical portion 18 and a deviated, or horizontal portion 20.

An intervention work string 22 is disposed within the wellbore 10. The intervention work string 22 can be used to perform workover tasks, such as pumping chemicals into the wellbore 10 or running tools into the wellbore 10. The exemplary intervention work string 22 includes a coiled tubing running string 24 that is injected from surface 13 in a manner known in the art. Although a land-based well is depicted, those of skill in the art will understand that the systems and methods of the present invention can also be applied to subsea wells.

Figure 2:
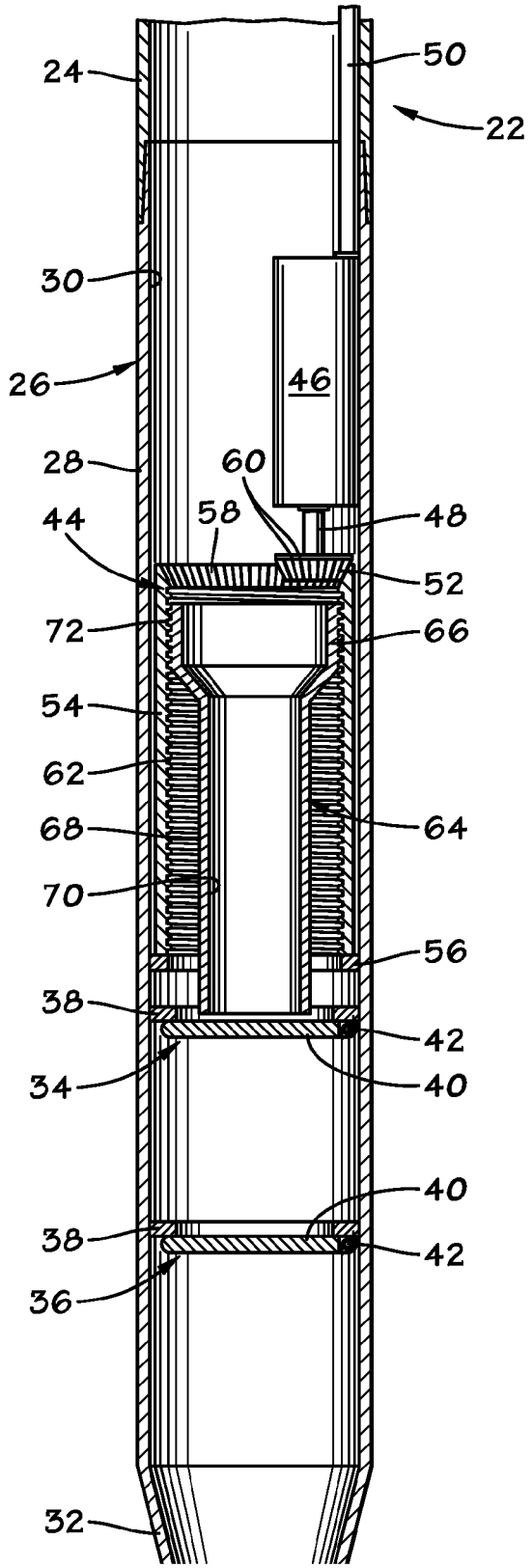
FIG. 2 is an enlarged cross-sectional view of the valve assembly of the intervention work string shown in FIG. 1 with the valve assembly in a closed position.

A multi-cycle open/close safety valve assembly 26 is secured to the distal end of the coiled tubing string 24. Referring now to FIG. 2, an exemplary valve assembly 26 includes an outer housing 28 that defines an interior flow bore 30. A connection 32 extends from the housing 28. One, or preferably two, spring-biased flapper valves 34, 36, of a type known in the art, are located within the housing 28. The flapper valve(s) 34, 36 are axially spaced apart from each other. Each flapper valve 34, 36 includes a valve seat 38. A flapper member 40 pivots about hinge 42 and is spring-biased into a closed position against its valve seat 38.

A valve actuation mechanism 44 is located within the flow bore 30 proximate the flapper valves 34, 36. FIG. 2 illustrates an exemplary valve actuation mechanism 44 which includes an electrical motor and/or battery operated system 46 which rotates a rotary shaft 48. Power and data commands are supplied to the motor 46 from surface via a conductor or fiber optic cable 50. In certain embodiments, the conductor 50 is tubewire which may be operable to transmits data uphole to the surface 13. The term "tubewire", as used herein, refers to a tube which may or may not encapsulate a conductor or other communication means, such as, for example, the tubewire manufactured by Draka Cableteq of North Dighton, Mass. Tubewire for example, might consist of a ⅛" outer diameter by 0.023" wall of stainless steel or Incoloy 825 tube containing 16-18 gauge stranded copper wire covered by Halar™ or Teflon™ insulator. In this example, the insulator is tight against the tube and the wire. In the alternative, the tubewire may encapsulate one or more fiber optic cables or a mixture of wire(s) and fiber optic cable(s). The tubewire may consist of multiple tubes and may be concentric or may be coated on the outside with plastic or rubber.

The exemplary valve actuation mechanism 44 also includes a gear wheel 52 that is affixed to the rotary shaft 48. A tubular roller screw member 54 is disposed within the flow bore 30. The roller screw member 54 is rotatable within the outer housing 28 and is retained against axial movement within the flow bore 30 by locking ring 56. The roller screw member 54 presents a toothed upper end 58 whose teeth intermesh with teeth 60 on gear wheel 52. In addition, the roller screw member 54 has a radially interior surface with threading 62 formed thereupon.

A prong member 64 is located within the roller screw member 54. Preferably, the prong member 64 includes a radially enlarged upper end 66 and a reduced diameter prong portion 68. An axial passageway 70 is defined through the prong member 64. The outer radial surface 72 of the enlarged upper end 66 has threading formed thereupon which is complementary to the threading 62 on the roller screw member 54. As a result of the intermeshing of the threading on the outer radial surface 72 of the prong member 64 and the threading 62, the prong member 64 will be moved axially within the housing 28 when the roller screw member 54 is rotated within the housing 28. The prong member 64 will be moved axially either upwardly or downwardly depending upon the direction of rotation of the roller screw member 54.

In operation, the intervention work string 22 is disposed within the wellbore 10 until the valve assembly 26 is located at a point wherein it is desired to perform an intervention task. A particular intervention task might be flowing chemicals through the coiled tubing string 24 and the valve assembly 26. Alternatively, flow or circulation (reverse) may be performed. In order to do these things, the valve assembly 26 must be opened.

Figure 3:
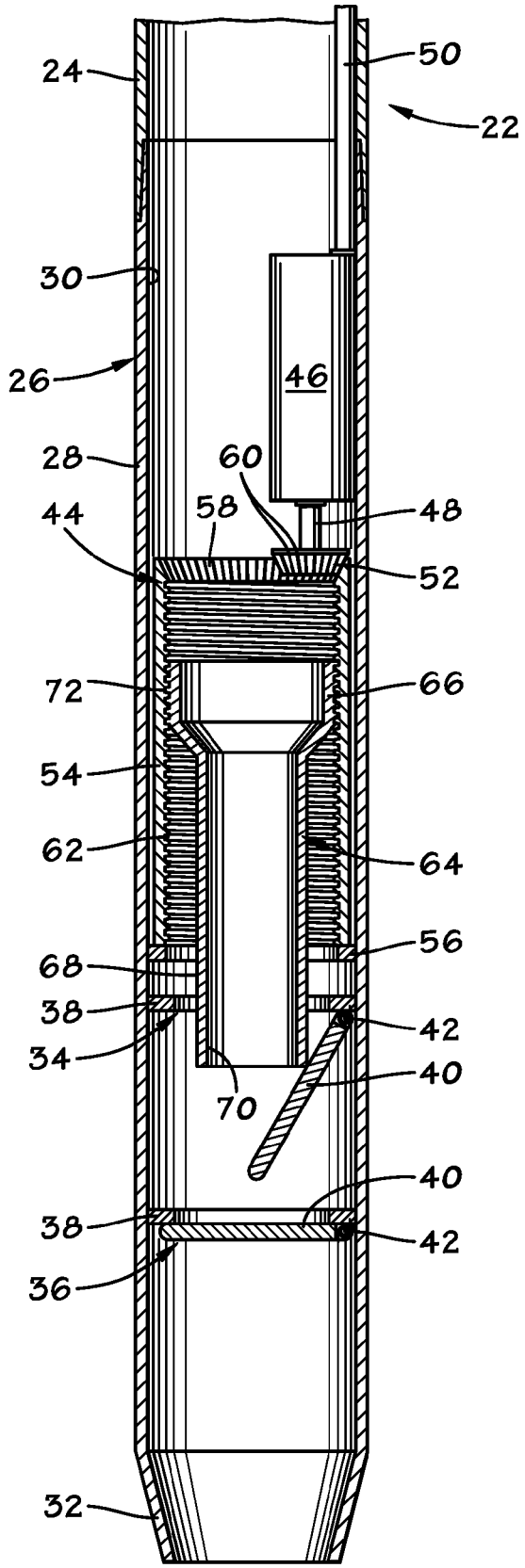
FIG. 3 is an enlarged cross-sectional view of the valve assembly of FIG. 2 with the valve assembly in a partially open position.
Figure 4:
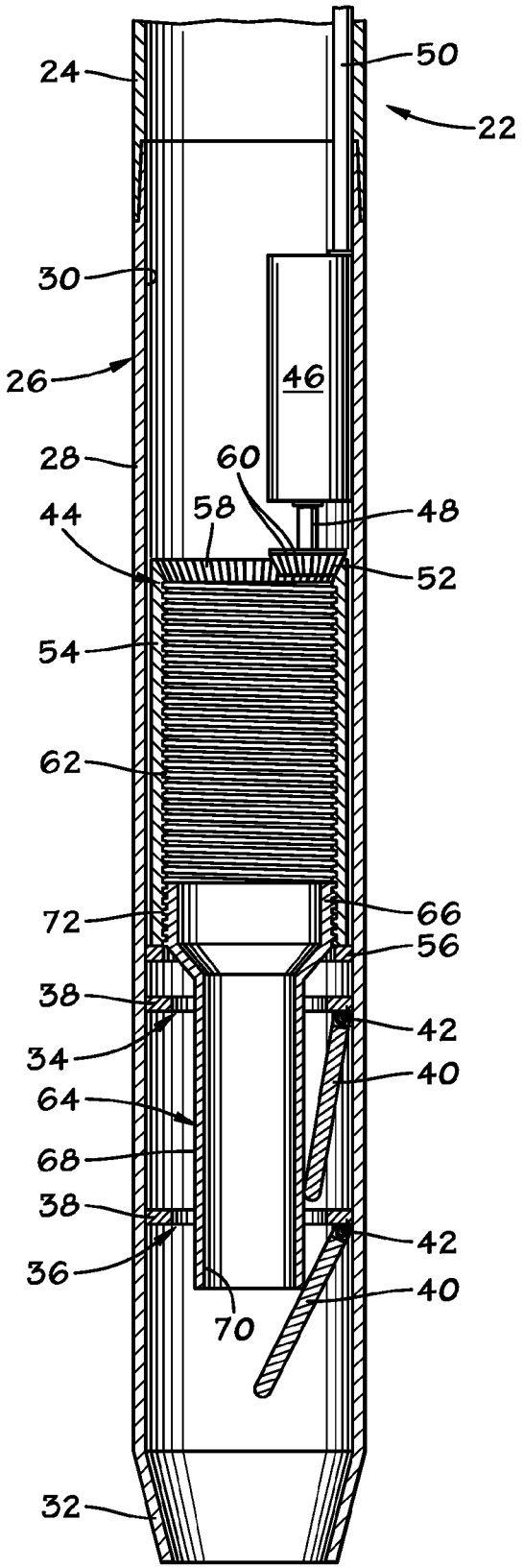
FIG. 4 is an enlarged cross-sectional view of the valve assembly of FIGS. 2-3 with the valve assembly now in a fully open position.

Opening of the valve assembly 26 is depicted in FIGS. 3 and 4. The motor 46 is energized by power/commands, provided via the conductor 50 so that the shaft 48 is rotated. The roller screw member 54 is rotated within the housing 28 which translated the prong member 64 axially downwardly within the housing 28 due to the interface of the threaded portions 62, 72. The prong portion 68 of the prong member 64 will first urge the upper flapper valve 34 to an open position, as shown in FIG. 3. As the prong member 64 is moved further downwardly within the housing 28, the prong portion 68 will urge the lower flapper valve 36 to an open position.

Once the valve assembly 26 has been opened, one or more intervention-related tasks can be performed through the open valve assembly 26. For example, fluids or chemicals could be flowed downwardly or upwardly through the intervention work string 26.

An operator can also close the flapper valve assemblies 34, 36 by energizing the motor 46 to rotate the shaft 48 and gear wheel 52 in the opposite direction. This will rotate the roller screw member 54 in the opposite direction and cause the prong member 64 to move axially upwardly within the housing 28.

Those of skill in the art will recognize that numerous modifications and changes may be made to the exemplary designs and embodiments described herein and that the invention is limited only by the claims that follow and any equivalents thereof.

What is claimed is:

1. A valve assembly within an intervention work string used for performing an intervention work task within a wellbore, the valve assembly comprising:

a housing defining a flowbore;

a plurality of flapper valve assemblies for selectively closing the flowbore, each of the flapper valve assemblies moveable between an open position and a closed position; a valve actuation mechanism for moving each flapper valve assembly between the open and closed positions, wherein the valve actuation mechanism comprises:

a roller screw member that is disposed within and rotatable within the housing, the roller screw member having a radially interior surface with threading formed upon the radially interior surface, the roller screw member also presenting a toothed upper end having teeth which intermesh with teeth on a gear wheel;

a prong member that is located at least partially radially within the roller screw member and presenting an outer radial surface with threading thereupon to intermesh with the threading formed upon the roller screw member and wherein the prong member is moved axially within the housing upon rotation of the roller screw member; and the prong member having a prong portion to urge a flapper valve assembly to its open position.

2. The valve assembly of claim 1 further comprising a motor to rotate the roller screw member.

3. The valve assembly of claim 2 wherein the motor is located within a coiled tubing running string that is used to dispose the valve assembly into a wellbore.

4. The valve assembly of claim 2 further comprising a conductor to provide power and commands to the motor from a surface location.

5. The valve assembly of claim 4 wherein the conductor comprises tubewire.

6. The valve assembly of claim 1 wherein the gear wheel is rotated by a motor.

7. An intervention work string for performing an intervention task in a wellbore comprising:

a running string for disposing a valve assembly to a desired location within the wellbore;

a valve assembly affixed to the running string and comprising:

a housing defining a flowbore;

a plurality of flapper valve assemblies for selectively closing the flowbore, each of the flapper valve assemblies moveable between an open position and a closed position;

a valve actuation mechanism for moving each flapper valve assembly between the open and closed positions, wherein the valve actuation mechanism comprises:

a roller screw member that is disposed within and rotatable within the housing, the roller screw member having a radially interior surface with threading formed upon the radially interior surface, the roller screw member also presenting a toothed upper end having teeth which intermesh with teeth on a gear wheel;

a prong member that is located at least partially radially within the roller screw member and presenting an outer radial surface with threading thereupon to intermesh with the threading formed upon the roller screw member and wherein the prong member is moved axially within the housing upon rotation of the roller screw member; and the prong member having a prong portion to urge a flapper valve assembly to its open position.

8. The intervention work string of claim 7 wherein the running string comprises coiled tubing.

9. The intervention work string of claim 8 further comprising a motor to rotate the roller screw member.

10. The intervention work string of claim 9 wherein the motor is located within the running string.

11. The intervention work string of claim 9 further comprising a conductor to provide power and commands to the motor from a surface location.

12. The intervention work string of claim 11 wherein the conductor comprises tubewire.

13. The intervention work string of claim 7 wherein the gear wheel is rotated by a motor.

* * * * *